United States Patent [19]

Smith

[11] 4,289,075

[45] Sep. 15, 1981

[54] STEERING ARTICULATED CAR

[75] Inventor: Roy E. Smith, Kingston, Canada

[73] Assignee: Urban Transportation Development Corporation Ltd., Toronto, Canada

[21] Appl. No.: 924,544

[22] Filed: Jul. 14, 1978

[30] Foreign Application Priority Data

Jul. 12, 1978 [CA] Canada ..... 307239

[51] Int. Cl.[3] ..... B61D 3/10; B61F 3/12; B61F 5/44; B61F 5/50

[52] U.S. Cl. ..... 105/4 R; 105/165; 105/166; 105/168; 105/196; 105/199 R; 105/199 C

[58] Field of Search ..... 105/4 R, 165, 168, 176, 105/166, 167, 169, 170, 196, 199 R, 199 C

[56] References Cited

U.S. PATENT DOCUMENTS

| | | | |
|---|---|---|---|
| 307,017 | 10/1884 | Cleveland | 105/170 |
| 355,720 | 1/1887 | Robinson | 105/165 |
| 461,680 | 10/1891 | Hunt | 105/165 |
| 727,919 | 5/1903 | Ellery | 105/168 |
| 1,064,167 | 6/1913 | Pintner | 105/165 |
| 1,138,357 | 5/1915 | Curwen | 105/165 X |
| 1,388,508 | 8/1921 | Brilhart | 105/4 R |
| 1,408,167 | 2/1922 | Brilhart | 105/4 R |
| 1,493,682 | 5/1924 | Kruger | 105/165 |
| 1,852,209 | 4/1932 | Kirchner | 105/165 |
| 2,042,623 | 6/1936 | Montrose-Oster | 105/165 X |
| 2,057,930 | 10/1936 | Strauss | 105/168 X |
| 2,098,723 | 11/1937 | Frei | 105/168 |
| 2,193,046 | 3/1940 | Strauss | 105/167 X |
| 2,785,640 | 3/1957 | Furrer | 105/168 X |
| 2,812,726 | 11/1957 | Bock et al. | 105/168 X |
| 2,834,303 | 5/1958 | Furrer | 105/168 X |
| 2,846,954 | 8/1958 | Gaynor | 105/168 X |
| 2,908,229 | 10/1959 | Furrer | 105/168 X |
| 2,936,720 | 5/1960 | VanAlstine | 105/168 X |
| 3,434,432 | 3/1969 | Seifert | 105/168 X |
| 3,528,374 | 9/1970 | Wickens | 105/168 X |
| 3,862,606 | 1/1975 | Scales | 105/167 |

FOREIGN PATENT DOCUMENTS

| | | | |
|---|---|---|---|
| 552538 | 6/1932 | Fed. Rep. of Germany | 105/4 R |
| 590867 | 1/1934 | Fed. Rep. of Germany | 105/4 R |
| 850623 | 9/1952 | Fed. Rep. of Germany | 105/168 |
| 2123876 | 11/1971 | Fed. Rep. of Germany | 105/176 |
| 2332897 | 6/1977 | France | 105/176 |
| 571989 | 1/1958 | Italy | 105/168 |
| 300386 | 9/1965 | Netherlands | 105/168 A |
| 139626 | 9/1930 | Switzerland | 105/4 R |
| 479714 | 2/1938 | United Kingdom | 105/168 B |
| 1053968 | 1/1967 | United Kingdom | 105/176 |

*Primary Examiner*—Joseph F. Peters, Jr.
*Assistant Examiner*—Howard Beltran
*Attorney, Agent, or Firm*—Rogers, Bereskin & Parr

[57] ABSTRACT

An articulated railroad vehicle having two or more body portions is supported on three or more single wheel set trucks. Each truck is pivotally attached to a vehicle body portion. Sensing elements detect the angle between the articulated body portions. The output from the angle of articulated sensing element means is used to guide each of the wheel sets to a radial configuration when the vehicle negotiates a curve.

6 Claims, 6 Drawing Figures

STEERING ARTICULATED CAR

This invention relates to railway car equipment and in particular, relates to railroad vehicle having a single wheel set at either end, each of which wheel sets may assume a radial alignment when the vehicle is travelling on a curved section of track.

Typically a railroad vehicle in use today will comprise a pair of trucks at the vicinity of either end of the railway vehicle. Each of the trucks will contain two wheel sets. Typically a wheel set comprises a pair of flanged wheels having conical surfaces that contact the guiding rails and a single axle. Each wheel of the wheel set is affixed to the axle such that the wheels and axle turn at the same angular speed. With such a fixed wheel set the axle is self-aligning on the railroad track. As will be obvious to those skilled in the art the conical surface of each wheel which contacts the rail generates forces in the wheel set known as creep forces which will keep the wheel set generally perpendicular to a tangent to the rails at the point of contact but these forces also have a tendency to over control and thus cause an instability generally known as "hunting".

Heretofore, it has been considered that a single wheel set using conical wheels is an unstable system if the wheel sets are allowed freedom to align themselves to curves in the track, and various attempts have been made to provide for curve negotiation by the vehicle with stability. Typically, wheel set stability has been achieved by equipping the vehicle with short wheelbase trucks. Each truck consists of a pair of wheel sets arranged in a comparatively short wheelbase and the two axles of the truck are fixed to the truck frame such that the axles remain parallel at all times. The truck frame is allowed to pivot relative to the vehicle body to negotiate curves. While this system is stable, problems arise with such trucks when the vehicle rounds railway curves.

Typically railroad vehicles are used in trains comprising more than one vehicle. It will be understood by those skilled in the art that as a single railway vehicle negotiates a curve the body of the vehicle will assume a "chord" position. Thus, a train comprising two or more vehicles when negotiating a curve will consist of a number of vehicles all of which have assumed a chorded position with respect to the curve being negotiated. In this invention the chording effect of two coupled bodies is used to maintain single wheel sets in radial position.

For the purposes of this description the word vehicle shall hereinafter refer to a single articulated vehicle having two body portions and supported on three or more wheel sets, which definition shall include a pair of like bodies each supported on two wheel sets which bodies are pivotally affixed together for travel along the track, this latter unit being hereinafter referred to as a "married pair".

According to this invention each of the single wheel sets of an articulated vehicle having three or more such wheel sets may be guided to a radial alignment when such vehicle negotiates a railroad curve by means of operating mechanisms, the amount of motion of which is proportional to the angle between the body portions of the articulated vehicle.

The articulated vehicle of this invention comprises two body portions pivotally linked together for relative pivotal movement about a vertical axis and pivotally supported on and having three or more wheel sets adapted for individual pivotal movement, means to sense changes in the relative angle between the body portions, and means to guide each of the wheel sets, and means interconnecting the sensing means and the guiding means such that the wheel sets are radial to the curve of the track.

A preferred embodiment of the invention will now be described in association with the following drawings in which.

Figure 1:
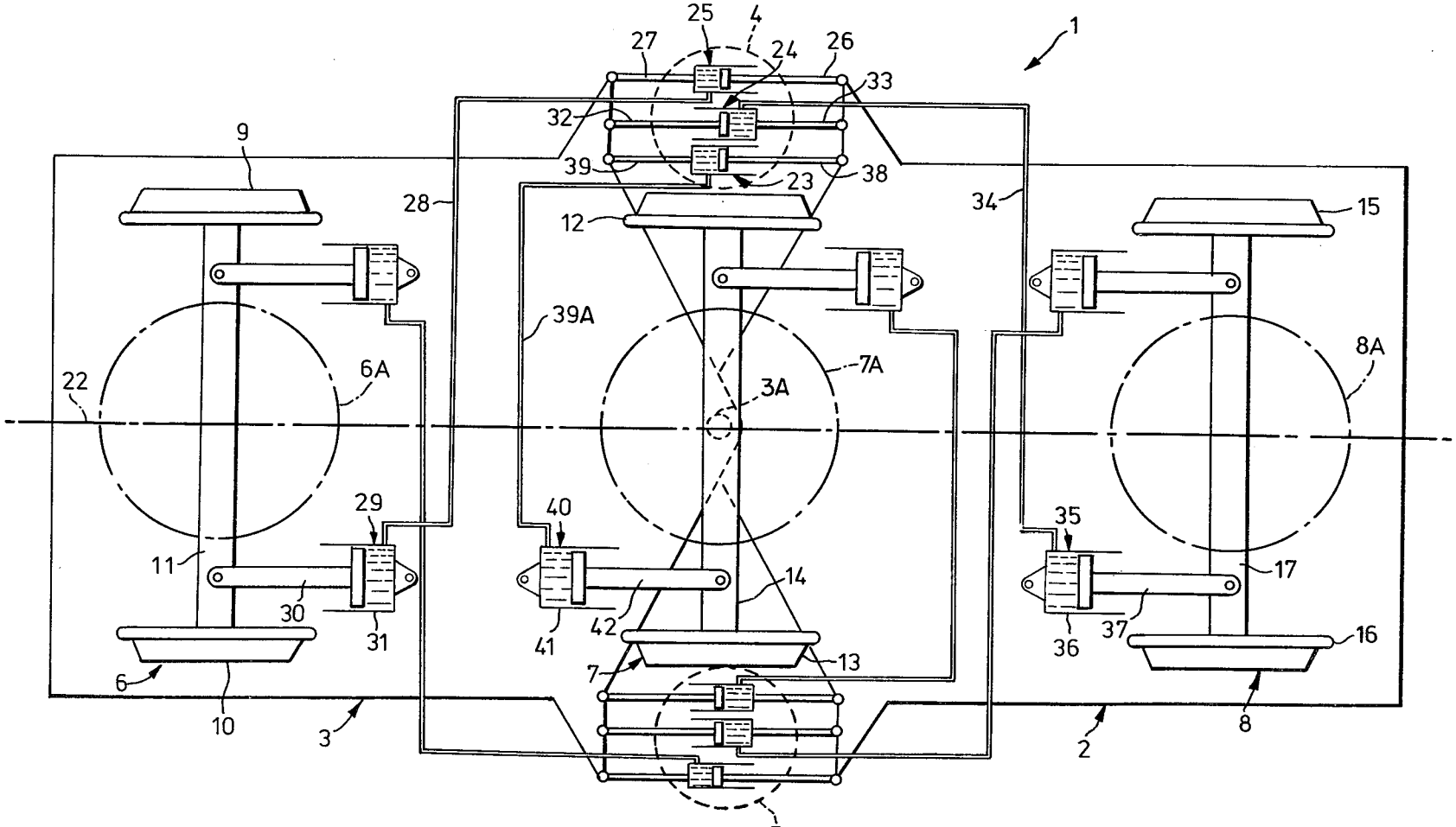
FIG. 1 is a schematic plan view of a preferred embodiment of this invention illustrating an articulated vehicle having 3 independent wheel sets in the alignment when travelling on tangent track.

FIG. 1 diagrammatically illustrates an articulated vehicle indicated generally as 1 comprising two similar body portions 2 and 3 pivotally attached at 3A. Elements to sense the angle of articulation shown generally as 4 and 5 extend between the body portions 2 and 3. The vehicle body 1 is supported by three wheel sets 6, 7 and 8. Wheel set 6 comprises flanged wheels 9 and 10 and an axle 11. Wheel set 7 comprises flanged wheels 12 and 13 and an axle 14. Wheel set 8 comprises flanged wheels 15 and 16 and an axle 17. Wheel sets 6, 7 and 8 are attached to the articulated vehicle to permit pivotal movement with respect to the vehicle 1 by pivotal means 6A, 7A and 8A.

Figure 4:
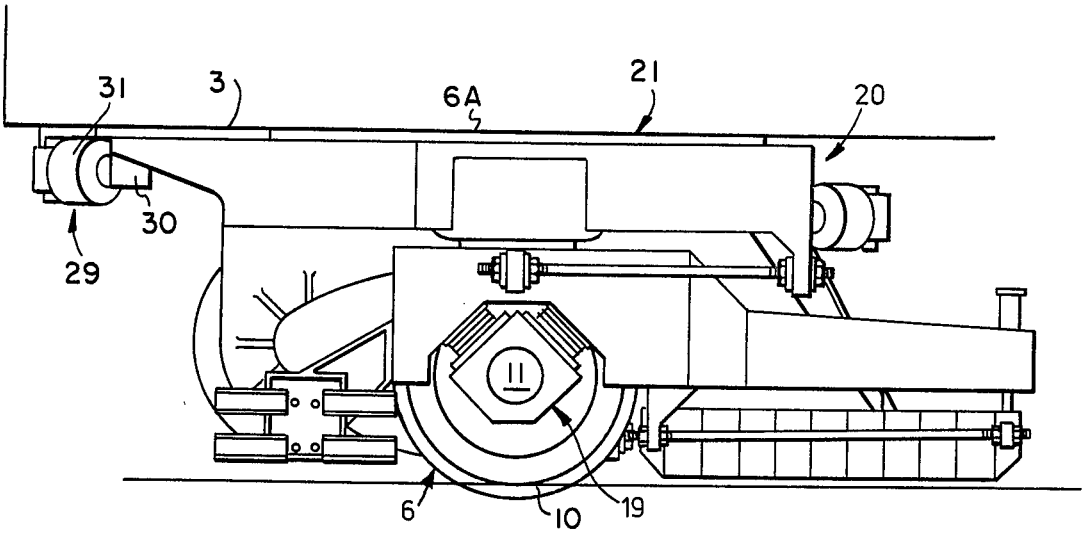
FIG. 4 is an elevation view of the suspension system of FIG. 3.
Figure 3:
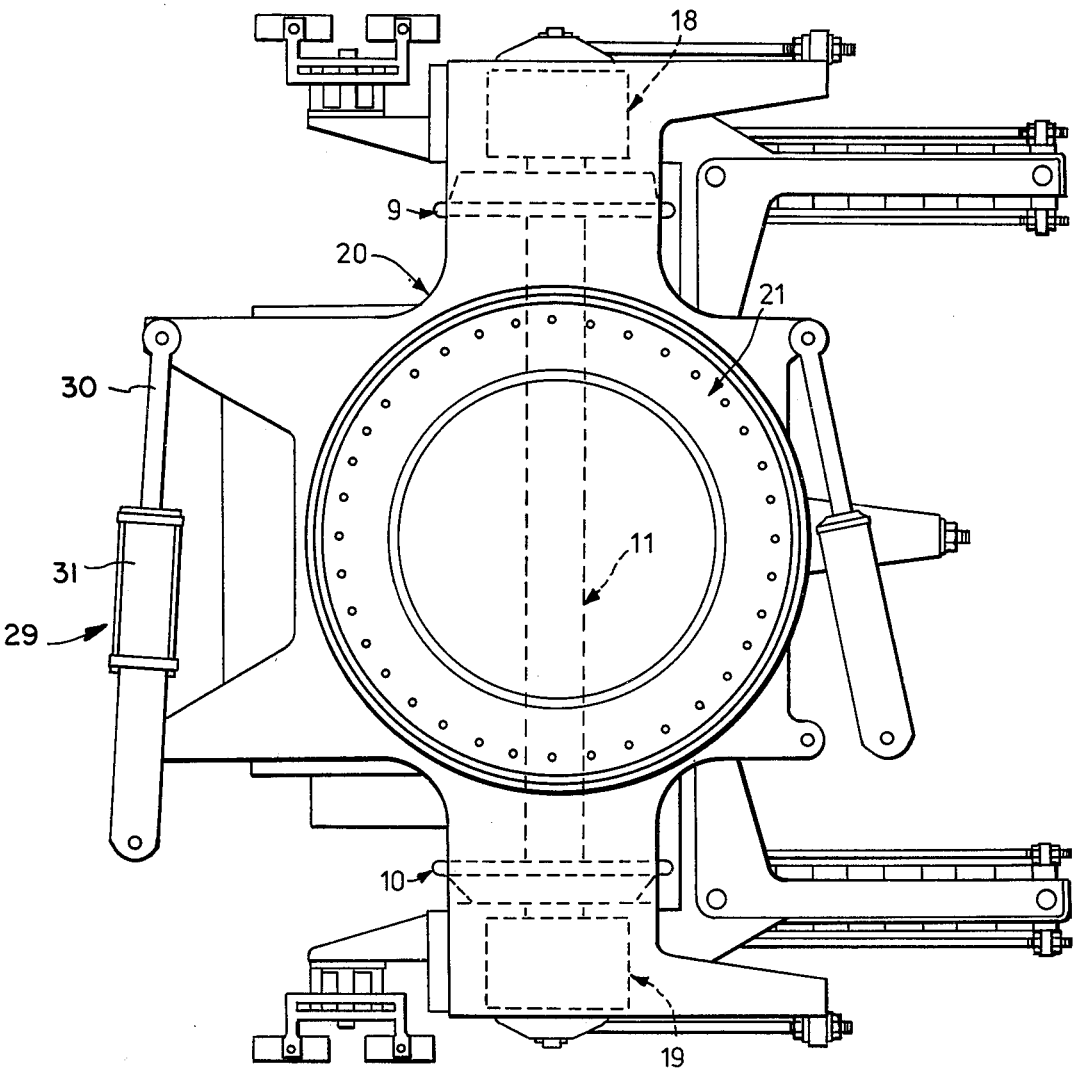
FIG. 3 illustrates a single axis suspension system used with the articulated vehicle.
Figure 5:
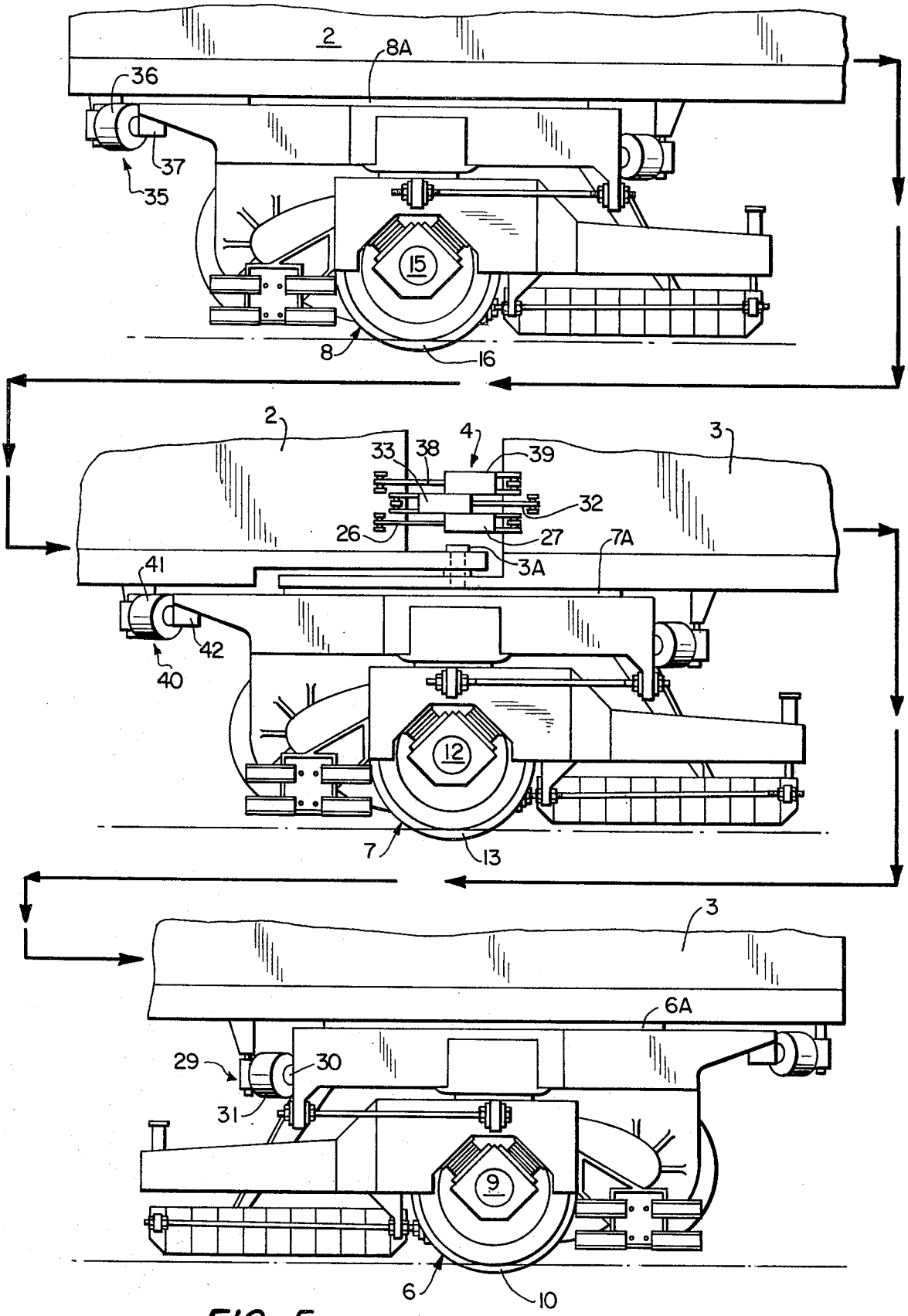
FIG. 5 is a side elevation view combining the schematic representation of FIG. 1 with the structural views of FIGS. 3 and 4.

FIGS. 3 and 4 illustrate a single axle suspension system which is of conventional design familiar to those skilled in this art but including a pivot bearing mounted on a bolster in the conventional sense as used with the conventional two wheelset truck. This design may be used with the articulated vehicle shown in the preferred embodiment. Wheel set 6 comprises flanged wheels 9 and 10 and an axle 11. Axle 11 is journaled for rotation about a generally horizontal axis in bearing means 18 and 19. Bearing means 18 and 19 are fixed to a bolster 20 by a convenient means well known to those skilled in the art. The bolster 20 comprises a pivot bearing 21 for attachment of the wheel set and bolster to the articulated vehicle 1. Those skilled in the art will realize that vehicle suspension means such as resilient pads, springs, air bags and the like may be used in the vehicle suspension system as desired. Wheel sets 7 and 8 are suspended from similar suspension means as shown in FIGS. 3 and 4 with reference to wheel set 6.

Articulation sensing means 4 and 5 are essentially similar redundant units. For clarity articulation sensing means 4 will be described in detail, it being understood that articulation means 5 is an essentially similar system.

Figure 2:
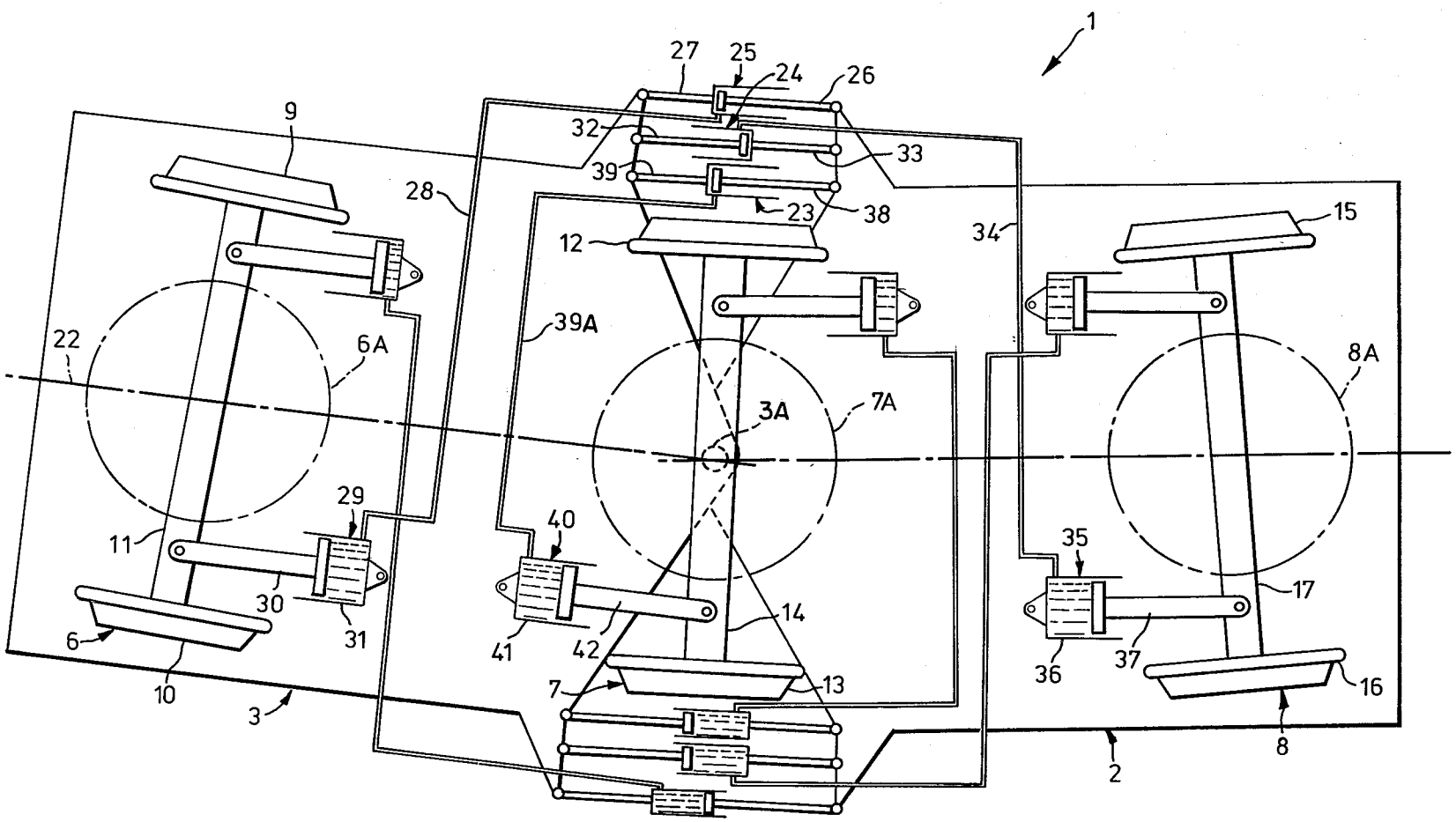
FIG. 2 is a schematic plan view of the vehicle of FIG. 1 in the alignment when travelling on curved track.

Vehicle 1 is essentially symmetrical about a longitudinal axis 22 which passes through the articulation joint between body portions 2 and 3. It will be observed that articulation sensing means 4 is located to one side of the longitudinal vehicle axis. A comparison of FIGS. 1 and 2 illustrates that as the vehicle 1 rounds the curve shown in FIG. 2 the body portions pivot with respect to one another such that the distance between body portions 2 and 3 sensed by articulation sensing means 4 is less then when the vehicle is travelling on tangent track. The reduction of the spacing between the body portions 2 and 3 at any corresponding point on each of said body portions is a direct function of the included angle between the longitudinal axes of each of the body portions. It will also be appreciated that the angle between the body portions 2 and 3 is determined by the radius of the curve on which the vehicle is travelling and the proportion of the vehicle. The shorter the radius of the curve the less will be the included angle between body portions 2 and 3 sensed by articulation angle sensing means 4. Articulation sensing means 5 being on the other side of the longitudinal vehicle axis 22 from articulation sensing means 4 will sense an increase of the angle, this increase being the same value as the decrease sensed by articulation sensing means 4.

Articulation sensing means 4 comprises three separate independently acting hydraulic actuators 23, 24 and 25. Hydraulic actuator 25 comprises a piston 26 affixed to vehicle body portion 2 and a cylinder 27 affixed to body portion 3. An oil flow line 28 connects hydraulic actuator 25 with an hydraulic actuator 29 attached to wheel set 6. Hydraulic actuator 29 comprises a piston 30 affixed to angle 11 and a hydraulic cylinder 31 affixed to vehicle body portion 3. It is to be noted that hydraulic actuator 29 is affixed to axle 11 at a position on the opposite side of the vehicle longitudinal axis 22 from the location of hydraulic actuator 25.

Hydraulic actuator 24 which also comprises a piston 32 affixed to vehicle body portion 3 and an hydraulic cylinder 33 affixed to vehicle body portion 2 is connected to hydraulic actuator 35 by means of oil flow line 34. Hydraulic actuator 35 comprises a hydraulic cylinder 36 affixed to vehicle body portion 2 and a hydraulic piston 37 affixed to axle 17 of wheel set 8. It is to be observed that hydraulic actuator 30 is attached to axle 17 on the opposite side of vehicle longitudinal axis 22 from that occupied by hydraulic actuator 24.

Hydraulic actuator 23 which is similar to actuators 24 and 25 comprises a hydraulic piston 38 affixed to body portion 2 and a hydraulic cylinder 39 affixed to body portion 3. Hydraulic actuator 23 is hydraulically connected to hydraulic actuator 40 by means of oil flow line 39A. Hydraulic actuator 40 comprises a hydraulic cylinder 41 attached to vehicle body portion 3 and a hydraulic piston 42 attached to axle 14 of wheel set 7. It is to be noted that hydraulic actuator 40 is located on the opposite side of the vehicle body longitudinal axis 22 from hydraulic actuator 23.

A review of FIGS. 1 and 2 will assist in understanding the operation of the invention shown in this embodiment. As the vehicle body rounds a curve the body portions 2 and 3 will pivot with respect to one another. Accordingly, each piston in the group of articulation angulation sensing means 4 will move toward the bottom of its associated hydraulic cylinder thereby expelling oil from the hydraulic cylinder. Oil will thus be expelled from cylinder 27 by piston 26 and flow through hydraulic line 28 into cylinder 31. The flow of oil into cylinder 31 will cause piston 30 to move outwardly thereby causing wheel set 6 to pivot about its pivotal attachment to body portion 3. In a similar fashion movement in a hydraulic actuator 24 will cause movement in hydraulic actuator 35 thereby causing wheel set 8 to pivot with respect to body portion 2. Similarly movement in actuator 23 will cause movement in actuator 40 thereby causing wheel set 7 to pivot with respect to body portion 3. It will be observed that wheel set 6 is caused to pivot in a clockwise direction with respect to vehicle body portion 3 whereas wheel set 8 is caused to pivot in a counterclockwise direction with respect to body portion 2. Similarly wheel set 7 pivots in a counterclockwise direction with respect to vehicle body portion 3.

The amount of movement of hydraulic actuator 29 is directly related to the amount of movement in hydraulic actuator 25. If the actuators are each equipped with identical sized pistons and cylinders then the movement would be on a one for one basis. However, if more convenient, any form of multiplication could be used. It should be appreciated that the amount of movement sensed by hydraulic actuator 25 is a function of the length of the vehicle 1, the wheel base of body portions 2 and 3, the radius of the curve which the vehicle is negotiating and finally, the distance from the longitudinal vehicle axis 22 to actuator 25. The amount of movement in actuator 29 required to guide wheel set 6 to the radial position will depend on the distance between vehicle longitudinal axis 22 and the location of actuator 29. It is considered that those skilled in the art will have no difficulty in correlating these various factors which may be plotted for the specific geometry of any vehicle so as to ensure that wheel set 6 remains in a radial configuration regardless of the radius travelled by the articulated vehicle. As all such correlations can be approximated to be of linear nature it is expected that those skilled in the art would have no difficulty in establishing such proportions.

It will be observed that hydraulic actuator 24 and its associated hydraulic actuator 35 connected to wheel set 8 operate in precisely the same manner so as to ensure that wheel set 8 assumes a radial configuration when travelling a curve. Similarly hydraulic actuator 23 ensures that wheel set 7 is guided to the radial configuration.

As shown in FIG. 2 angulation sensing means 4 is located radially inward of the longitudinal vehicle axis. Thus as shown in FIG. 2, the hydraulic actuators 23, 24 and 25 are each compressed thereby expelling oil. It will now be appreciated that if the vehicle were rounding a curve in the other direction the actuators 23, 24 and 25 would be radially outward from the vehicle longitudinal axis 22 and would expand as the vehicle enters the curve. This expansion would draw oil into actuators 23, 24 and 25 causing the associated actuators 40, 35 and 29 respectively to collapse inwardly as the oil flowed out of such actuators. This flow in the other direction from that previously explained will cause wheel set 6 to pivot with respect to vehicle body portion 3 in a counterclockwise direction, wheel set 7 to pivot with respect to body portion 3 clockwise and wheel set 8 to pivot with respect to body portion 2 in a clockwise direction so that the vehicle rounds a curve with all three wheel sets in the radial configuration. In order to achieve this double acting effect hydraulic actuators 29, 35 and 40 may be double acting or as shown in this embodiment single acting cylinders wherein ambient air pressure is delivered to the underside of each piston. As the wheel sets will themselves attempt to assume the radial position it will be realized that no substantial external force is required to pivot the wheel sets.

Angulation sensing means 5 is identical to angulation sensing means 4. Angulation sensing means 5 however is connected to cylinders attached to each of wheel sets 6, 7 and 8 on the opposite side of cylinders 29, 40 and 35 respectively. Angulation sensing means 5 will thus operate in precisely the reciprocal manner of angulation sensing means 4. It will be understood by those skilled in the art that sensing means 4 and 5 are therefore redundant. However, it is suggested that in the interests of safety for a passenger conveying vehicle that such redundant means are desirable.

As stated hereinbefore each of the wheel sets is free to pivot with respect to the vehicle body subject to moving oil through the hydraulic circuits as described hereinabove. This system provides unique stability for a single axle. The stability of the system may be more clearly understood if one of the wheel sets is discussed in detail.

If the speed of the vehicle is such that wheel set 6 would otherwise be unstable in the yaw mode then the wheel set will attempt to deviate from a configuration where it is perpendicular to a tangent to the track. However, in order for the wheel set to deviate from this position it must cause oil to flow through the hydraulic circuits explained above from actuator 29 into actuator 25. Flow of oil into actuator 25 can only be accomplished if vehicle body portion 2 pivots with respect to body portion 3. Body portion 2 cannot pivot with respect to body portion 3 as to do so exerts a lateral force in wheel sets 8 and 7 which is resisted by each wheel set. It is to be observed therefore that the stability of wheel set 6 is provided not by a longitudinal reaction of axle 11 parallel to the track but rather by a transverse reaction in the axles 14 and 17 perpendicular to a tangent to the track. This analysis is identical regardless of whether the vehicle is travelling on curved track or on tangent track. Accordingly, the system disclosed herein provides the appropriate stability without significantly decreasing the amount of longitudinal force that may be available at the wheels 9 and 10. A similar analysis for each of wheel sets 7 and 8 indicates that the stability for each wheel set is provided by lateral restraints in each of the other two wheel sets.

In the preferred embodiment illustrated hereinbefore hydraulic means have been suggested as the means to sense the relative angularity between body portions 2 and 3 and to guide the movement of each wheel set to the radial position. It will be obvious however that other means may be provided. Typically, pure mechanical linkages could be used such as a lever system between body portions 2 and 3. Such levers could be used to directly guide wheel sets 6, 7 and 8 in a manner analogous to that explained above with regard to the hydraulic circuits. Other means of sensing the angularity between the body portions may also be used to guide the wheel sets to the radial alignment. Servo and electrical sensing and actuating means can also be used with this invention. In certain cases it may also be desirable to use a three axle articulated truck made according to the invention disclosed herein.

Figure 6:
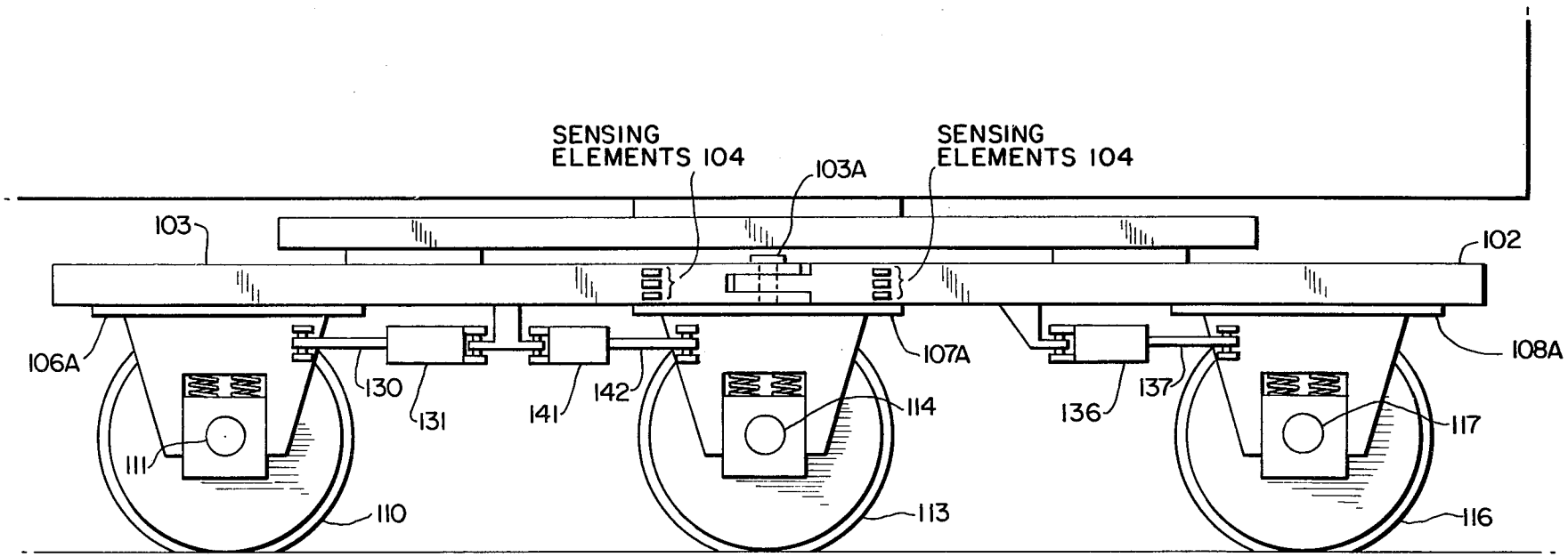
FIG. 6 is a side elevation view of an articulated truck according to the instant invention.

The three axle articulated truck made according to the invention is illustrated in FIG. 6. Each of the elements has been numbered in the same manner as in FIGS. 1–5, with the exception that they have been increased by "100". Thus, the body portions of the articulated truck are seen as 102 and 103 and are comparable to the vehicle body portions 2 and 3, respectively. Otherwise, the construction and operation of the truck illustrated in FIG. 6 is identical to that illustrated in FIGS. 1–5. Specifically, a body portion 102 is pivoted to a body portion 103 at 103A. The wheel sets are attached to permit pivotal movement by means of 106A, 107A and 108A. The wheels 110, 113 and 116 are attached in the manner as discussed above to axles 111, 114 and 117, respectively.

The sensing elements 104 are mounted on the members 102 and 103 at the pivot 103A to indicate the angular relationship between the members about the pivot 103A.

The pistons 130, 142 and 137 cooperate with cylinders 131, 141 and 136, respectively. Obviously, other corresponding elements as seen particularly in FIGS. 1 and 2 will be found in their corresponding locations in the truck shown in FIG. 6.

I claim:

1. An articulated railway vehicle comprising first and second pivotally connected body portions, at least three spaced, independently controlled wheel sets supporting said vehicle, each of said wheel sets being attached to said vehicle for pivotal movement about respective substantially vertical, horizontally displaced axial pivots, sensing means for sensing changes in the relative angle between said first and said second body portions, actuating means for effecting pivotal movement of each of said wheel sets, and means connecting said sensing means and said respective actuating means for positioning said wheel sets by said actuating means to a substantially radial alignment when said articulated vehicle travels curved railway track.

2. The vehicle of claim 1 wherein said sensing means include first and second redundant portions, each portion being located between said vehicle portions.

3. The vehicle of claim 2 wherein said sensing means and said actuating means includes sensing hydraulic actuators and wheel set hydraulic actuators, respectively.

4. The vehicle of claim 3 wherein each sensing means comprises an independently acting sensing hydraulic actuator for each wheel set, and each sensing hydraulic actuator being hydraulically connected to a single wheel set hydraulic actuator.

5. The vehicle of claim 4 wherein each wheel set is positioned by two wheel set hydraulic actuators, one of said wheel set hydraulic actuators being hydraulically connected to a sensing hydraulic actuator of said first portion of said sensing means, and the other of said wheel set hydraulic actuators being hydraulically connected to a sensing hydraulic actuator of said second portion of said sensing means.

6. An articulated truck for a railway vehicle comprising first and second pivotally connected truck portions, said truck having three wheel sets attached to said truck for pivotal movement about respective substantially vertical axial pivots, sensing means for sensing changes in the relative angle between said first and second portions, actuating means for effecting pivotal movement of each of said wheel sets, and means connecting said sensing means and said respective actuating means for positioning said wheel sets by said actuating means to a substantially radial alignment when said articulated truck travels curved railway track.

* * * * *